United States Patent [19]

Lutz

[11] Patent Number: 4,557,658

[45] Date of Patent: Dec. 10, 1985

[54] MATERIAL-HANDLING APPARATUS

[76] Inventor: Theodore A. Lutz, R.D. 1, Box 276, Rochester Rd., Sewickley, Pa. 15143

[21] Appl. No.: 403,072

[22] Filed: Jul. 29, 1982

Related U.S. Application Data

[63] Continuation of Ser. No. 136,232, Apr. 1, 1980, Pat. No. 4,372,726.

[51] Int. Cl.[4] ..... B65F 1/00

[52] U.S. Cl. ..... 414/517; 414/512; 100/193

[58] Field of Search ..... 414/509, 512, 517, 525 R; 100/229 A, 193; D15/83, 87, 88; 114/203

[56] References Cited

U.S. PATENT DOCUMENTS

| | | | |
|---|---|---|---|
| 2,984,370 | 5/1961 | Wade | 414/512 |
| 3,250,414 | 5/1966 | Pioch | 100/229 A |
| 3,610,139 | 10/1971 | Bowles | 110/229 A |
| 3,695,175 | 10/1972 | Bausenbach et al. | 100/229 A |
| 3,734,006 | 5/1973 | Hennells | 100/193 |
| 3,753,506 | 8/1973 | Palmer et al. | 100/229 A |
| 3,880,072 | 4/1975 | Ord | 100/229 A |
| 3,888,528 | 6/1975 | Jericijo | 114/203 |
| 4,071,991 | 2/1978 | Hulligan | 100/229 A |
| 4,113,125 | 9/1978 | Schiller | 414/525 R |

FOREIGN PATENT DOCUMENTS

| | | | |
|---|---|---|---|
| 2156572 | 6/1973 | Fed. Rep. of Germany | 100/229 A |

*Primary Examiner*—Galen L. Barefoot
*Assistant Examiner*—Stephen P. Avila
*Attorney, Agent, or Firm*—Clifford A. Poff

[57] ABSTRACT

A container with reinforced side walls includes an internal partitive wall forming two longitudinal compartments each associated with a transfer member including a ram to compact refuse and other waste materials into the container compartment. Push-out assemblies are supported at the rear of each compartment to eject compacted material therein. A hinged door on the partitive wall is latched by a load-bearing assembly to a side wall while forming an entry port below the door. A container end door is closed against the upper portion of the container. An opening in the lower part of the door communicates with two entry portal openings for delivery of material into the compartments. Separate security chutes communicate with separate charging boxes formed in the compactor.

2 Claims, 9 Drawing Figures

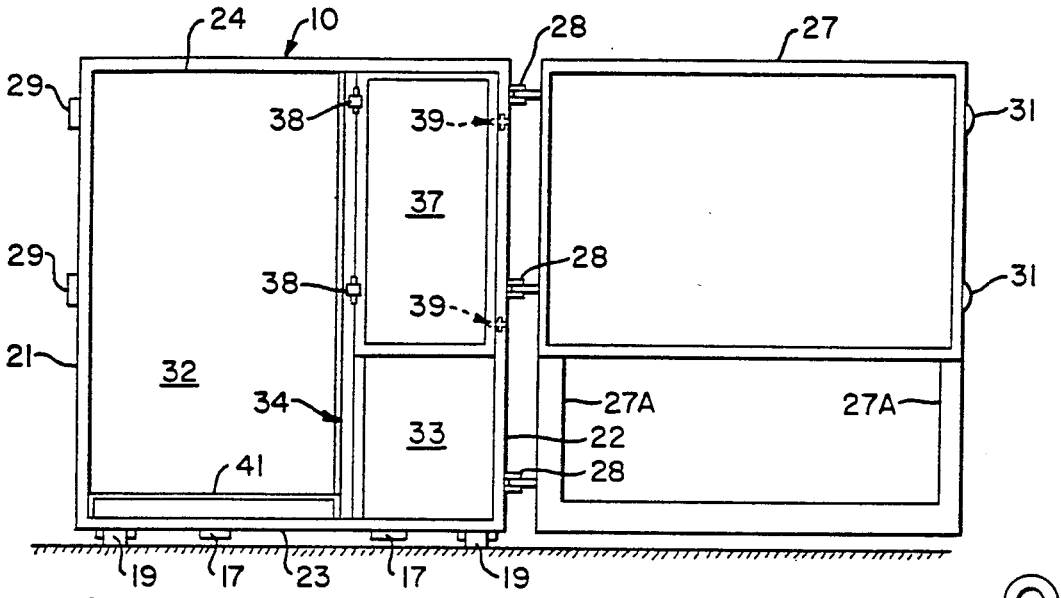
Fig. 3
Fig. 4
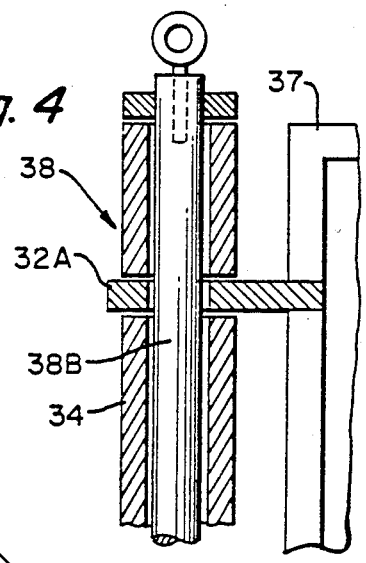
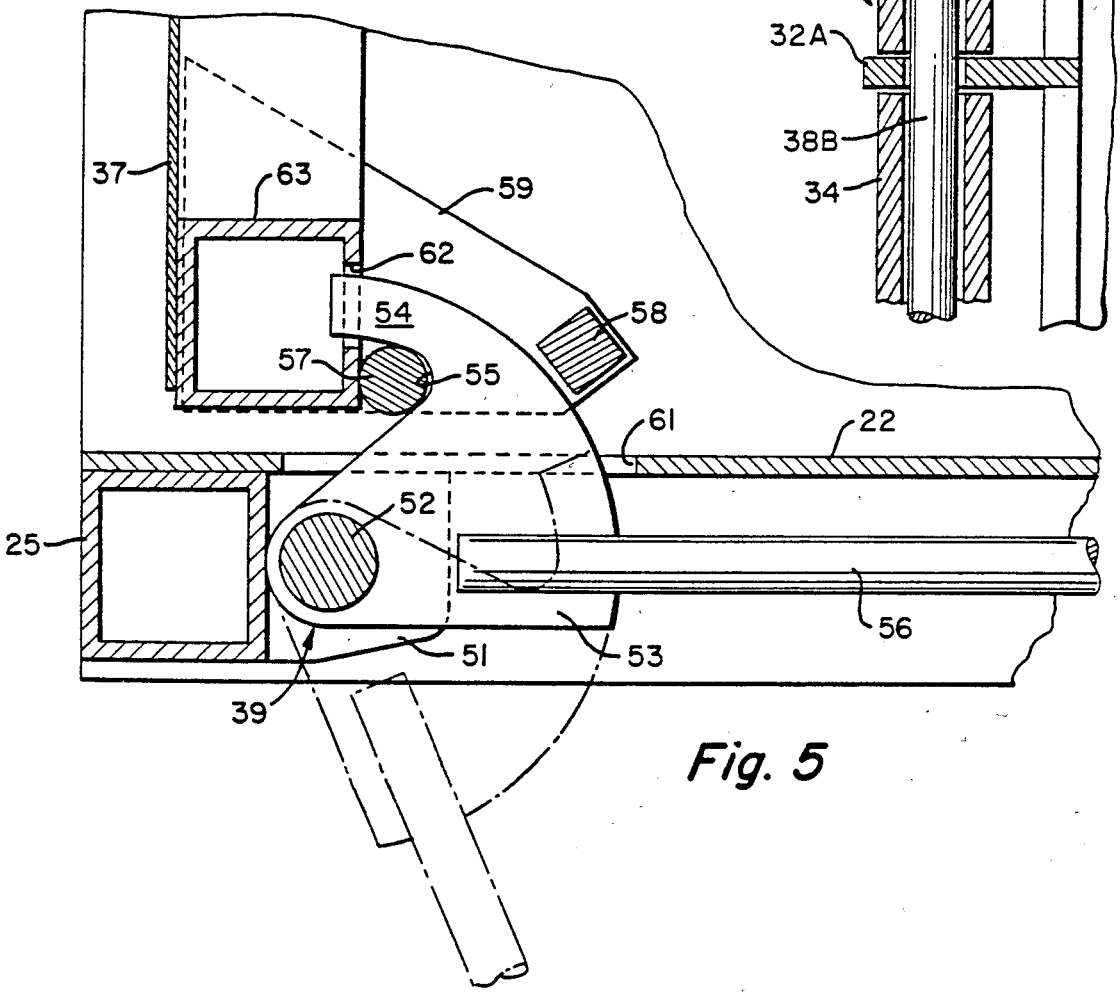
Fig. 5

MATERIAL-HANDLING APPARATUS

This is a continuation of application Ser. No. 136,232, filed Apr. 1, 1980 now U.S. Pat. No. 4,372,726.

BACKGROUND OF THE INVENTION

This invention relates to a material-handling apparatus of the type essentially comprised of a container having an internal partitive wall forming two longitudinal compartments, each associated with a transfer member including a ram to compact refuse or other waste materials into the compartment. More particularly, the present invention relates to an improved compacting and container apparatus having side-by-side compartments for more efficiently and economically handling the disposal of waste materials.

It is a generally accepted and well-known practice to use a transportable container for accumulating and storing a compacted load of waste or refuse material. Typically, the container is used to handle refuse from institutions and commercial establishments, such as food and dry-goods stores. The container is designed for loading, transporting and unloading by a truck equipped with a specially-designed chassis. The container embodies a heavy-welded steel construction with reinforced walls and has a capacity of up to about 42 cubic yards. At a designated loading site, the container is mechanically coupled to a compacting unit usually located at a fixed position adjacent a building. A chute is sometimes provided in the side wall of the building to direct waste material into a charging box within the compactor. A ram with a hydraulically-operated piston and cylinder assembly forces the material from the compactor into the container. The bulk of the refuse in the container is reduced because of the relatively high pressure with which the refuse is forced into the container. This increases the density of the waste material to reduce the frequency for transporting the container to a disposal site, thereby lowering the cost. One form of such a known compacting system of the type just described is shown in U.S. Pat. No. 3,250,414.

The availability and ever-increasing cost for disposal sites have become increasingly acute, particularly in populace areas. To reduce the demands for disposal sites and the accompanying cost, the present invention provides for the disposal of refuse in a manner that will permit recycling of some and usually a major part of the waste materials. The idea of recycling corrugated and other paper products is per se well known in the art, but has not been acceptably achieved in the container systems associated with compactors of the type described above. The acute solid waste disposal problem can be alleviated by separation of waste materials prior to compaction whereby upon compaction, material for recycling is isolated from solid waste requiring any of the well-known forms of disposal. The present invention is based on the discovery that a single container can be designed to handle material to undergo recycling and separately handle other waste material to undergo conventional disposal. Typically, such waste materials from department stores, supermarkets and the like are comprised of only about 25% to 30% refuse while the vast majority making up the remaining 70% to 75% is comprised of paper and paper products suitable for recycling. Moreover, the material for recycling can be used as fuel in a resource recovery system. The residence time for waste material temporarily stored in a container must be monitored to insure that the container is emptied at regular intervals, such as at least once each week. This minimizes health and fire hazards.

SUMMARY OF THE INVENTION

It is an object of the present invention to provide a material-handling apparatus embodying a design and construction of parts to reduce the cost and expense of disposal for waste material but at the same time, to facilitate separation, compaction, storage as well as removal of compacted material from the apparatus at one or different disposal sites.

It is a further object of the present invention to provide a container having an internal partitive wall supported by floor and roof walls between side walls of the container to subdivide the space enclosed by the walls into storage compartments, each adapted to receive sorted waste material ejected into the compartments by individual compacting means including rams communicating with portal openings at one end of the container.

More specifically, according to the present invention, there is provided a material-handling apparatus including a container having upstanding side walls, a bottom wall and a roof wall joined together along side edges. The container further having a front end wall means and a rear door means at opposite ends of the container walls, hinge means to support the rear door means, an internal partitive wall supported by the floor wall and roof wall between the side walls for subdividing the space enclosed by the walls into two longitudinal storage compartments in side-by-side relation at opposite lateral sides of the internal partitive wall, latch means to retain the rear door means in a closed position against part of some of the walls to define two portal openings, each communicating with one of the storage compartments for separate passage of material into each compartment, transfer means including two rams each communicating with one portal opening to separately advance material into the compartments under a compacting force, and means to support the transfer means for detachable connection to the container.

In the preferred embodiment of the present invention, the transfer means further includes two charging boxes, each having a material-receiving opening traversed by one of the aforesaid rams for displacing material into a compartment of the container. A supply chute separately communicates with each material-receiving opening of the charging boxes such that the chutes may be labeled and separately used for one class of refuse capable of being recycled and a second class of refuse requiring a different mode of disposal. The storage compartments of the container define unequal volumes and the compartment for refuse intended for recycling may include a raised floor to prevent contamination with liquid that may accumulate within the space beneath the raised floor in the container. The width of the smallest compartment in the container which is the distance between the partitive wall and the side wall, should be of sufficient size, e.g., about 24 inches, to facilitate construction, maintenance and use. It is particularly advantageous to provide a compartment door to form a releasable spacing support member between the partitive wall and a side wall of the container. Such a door member is supported by hinges along one edge. A load-bearing latch arrangement along the other edge is designed to withstand forces imposed on the partitive wall during the compacting operation and facilitates separate removal of material from each compartment.

An operator's control arm coupled to a latch plate of the latch arrangement remains free of the forces developed within both storage compartments, thereby providing greater safety for an operator.

These features and advantages of the present invention as well as others will be more fully understood when the following description is read in light of the accompanying drawings illustrating the preferred embodiments of the present invention, and wherein:

FIG. 3 is an end elevational view of a container forming part of the material-handling apparatus taken along line III—III of FIG. 2;

FIG. 4 is an enlarged sectional view of the hinge arrangement for a compartment door shown in FIG. 3;

FIG. 5 is an enlarged sectional view of a latch apparatus taken along line V—V of FIG. 1;

Figure 2:
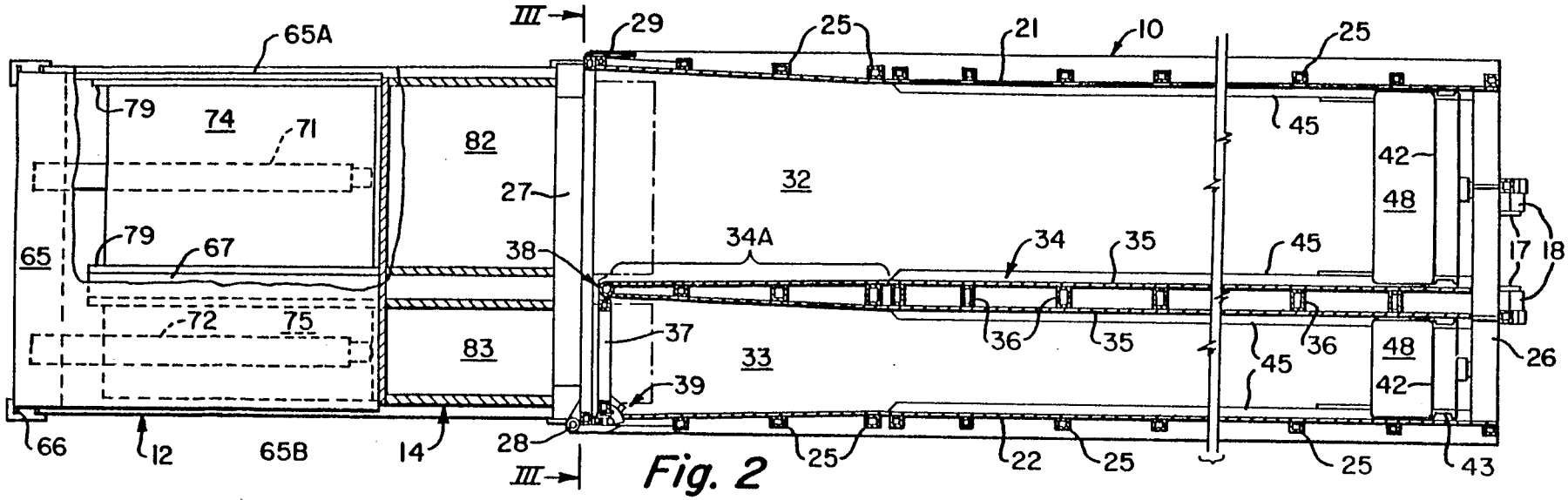
FIG. 2 is a sectional view, in plan, taken along line II—II of FIG. 1.
Figure 1:
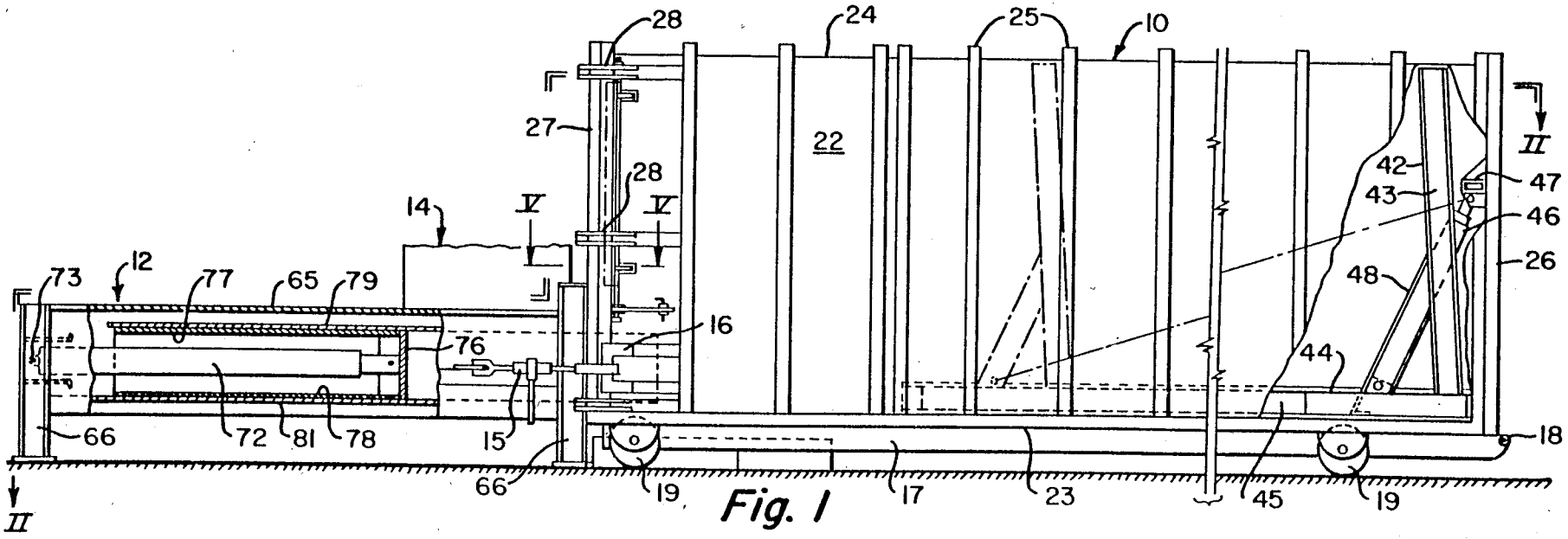
FIG. 1 is a side elevational view, partly in section, of the material-handling apparatus according to the present invention.

With reference now to FIGS. 1–3 of the drawings, the preferred embodiment of the material-handling apparatus according to the present invention includes a transportable container 10, a compactor 12 and a chute assembly 14. While not shown, a conventional truck equipped with a roll-off winch and a tiltable frame is used to transport the container to and from the position shown at predetermined time intervals or when the material stored in the container reaches the capacity of the container as may be indicated by any one of suitable well-known means. The container is released from the compactor by operation of clamp assemblies 15 attached to opposite lateral sides of the compactor and provided with a hook end for engaging a latch plate 16 welded or otherwise fastened to the sides of the container. The understructure of the container includes two longitudinal guide rails 17 that are spaced apart by a distance corresponding to the spacing between support rollers on the frame of the truck for support thereby. Each guide rail has a locking roller 18 to secure the container to the roll-off winch of the truck during transit. When removed from the truck, the container is supported by wheels 19 mounted onto the bottom of the container by support plates. A wheel is arranged at each corner portion of the container.

The container 10 includes side walls 21 an 22 adjoined along their side edges to a bottom wall 23 and a top wall 24. The walls 21–24 are typically comprised of metal plates or sheets reinforced by externally-arranged structural channels 25 that are spaced apart at regular intervals along the walls and attached by welding to the outer surfaces of the walls. An end wall 26, also comprised of a metal sheet or plate, is attached about its peripheral edges to end edge portions of the walls 21–24. Structural channels are used to reinforce the end wall which is located at the front part of the container. At the rear of the container, a door 27 is supported by spaced-apart hinges 28 to swing into and out of enclosing relation with the container. Along the edge of the door which is opposite hinges 28 are spaced-apart latch members 29 arranged for operative engagement with latch plates 31 (FIG. 3) to lock the door in a closed position during material-loading and transporting operations. In FIG. 3, the door 27, shown in its open position, defines a height which is sufficient to enclose the upper portions of two longitudinal compartments 32 and 33. It is preferred, but not necessary, to construct the door 27 with depending side edge portions 27A to extend along the lower portions of side walls 21 and 22 of the container. Such side edge portions form entry ports to the side-by-side compartments 32 and 33 which are defined at opposite sides of an internal partitive wall 34. The partitive wall extends between side walls 21 and 22 in a generally parallel relation therewith and into supporting engagement with floor wall 23, the roof wall 24 and end wall 26. The partitive wall 34 as shown in FIG. 2 is comprised of plate or sheet members 35 held in spaced-apart relation by structural channels 36 extending between the roof and floor walls at spaced-apart intervals. The partitive wall embodies a reinforced construction by welding the sheet members 35 to the channel member. The rear end portion 34A of the partitive wall is tapered which, together with tapered rear portions of side walls 21 and 22, define a progressively increasing width to each of the compartments 32 and 33 at the rear of the container. This facilitates movement of material in the compartments, both for loading and unloading operations.

During loading operation, door 27 is closed as illustrated in FIGS. 1 and 2 to completely overlie a compartment door 37. Door 37 is carried by hinges 38 that are supported by the partitive wall 34. Each hinge 38, as shown in FIG. 4, includes a hinge plate 38A welded to the door 37 at a site to extend into a slot-like opening in a hollow end post forming part of the partitive wall. A hinge pin 38B, with a collar and lifting hook at its top, is inserted into the hollowed area of the end post to pass through a bored opening in the hinge plate. Latch assemblies 39, as will be described in greater detail hereinafter, secure the door along its side edge opposite the hinges to wall 22. When door 27 is closed, door 37 must also be closed and locked which is the customary position of the parts during the container loading operation in which material is fed through either of two portal openings at the bottom of the doors into the compartment 32 or 33. Preferably, the area occupied by compartment 32 comprises between 70% and 75% of the total area enclosed within the container with the remaining 25% to 30% of the area comprising compartment 33. Compartment 32 typically receives corrugated and other paper products which are suitable for recycling, in which event such material is stored and removed from the container without contamination or admixture with refuse material stored in compartment 33. Door 37 facilitates the separate handling and discharge of material from each of the compartments 32 and 33. Since compartment 32 can be emptied independently of compartment 33, it is preferred, although not required, to provide a raised floor 41 (FIG. 3) in compartment 32 that is spaced by a relatively small distance, e.g., 2 to 3 inches above floor wall 23, to insure that material residing in compartment 32 remains out of contact with any liquid that might collect in the bottom of the container and seep from compartment 33 into compartment 32 by permeating the partitive wall 34.

It is preferred to provide push-out assemblies to facilitate ejection of material from the compartments 32 and 33. As shown in FIGS. 1 and 2, each push-out assembly, although having different widths to extend across the entire width of a compartment, is made up of the same arrangement of parts. Each push-out assembly includes an upstanding plate 42 reinforced by channel members 43 attached along the rear face of the plate. The bottom edge of the plate is attached to a platen 44 extending parallel to the floor of the container and received within the hollowed-out area of guide channels 45. The channels extend along partitive wall 34 and side walls 21 and 22 as close to the floor as possible and along the major part of the depth of the compartment. A piston and cylinder assembly 46 is attached at one end by a clevis to a bracket provided on the platen 44; while the other end of the piston and cylinder assembly is supported by a bracket extending from a cross brace 47. The piston and cylinder assembly 46, in the arrangement of parts as shown in FIGS. 1 and 2, embodies a multistage telescoping construction and extends in an upwardly-inclined manner while protected by closure frame 48. Upon actuation of the piston and cylinder assembly, the pushout assembly is advanced along the compartment in the direction toward the diverging wall portions arranged near the portal openings. Because of the pressure with which the material is forced into each of the compartments by the compactor 12, the bulk of the material is decreased by an increase to its density. This also significantly increases the force exerted by the material on the side walls forming each compartment. Thus, the side walls must embody a robust construction to withstand these forces including the forces developed during ejection of material through operation of the push-out assemblies. In FIG. 1, the push-out assembly is shown in its retracted position and its extended position of travel is indicated by phantom lines. It will be understood, of course, that various other arrangement of parts including orientation of the piston and cylinder assemblies 46 may be embodied in the container without departing from the spirit of the present invention. The diverging wall portions of the compartments facilitate entry and ejection of material from each compartment.

As previously described, the door 37 is arranged to span the distance between the side walls forming the compartment 33 and provided with lock assemblies 39 which embody a construction to increase the rigidity of the container walls for withstanding forces developed during the compacting operation. As shown in FIG. 5, brackets 51 are welded at spaced-apart locations along a channel 25 forming a corner post of the container. The brackets have aligned bored openings to support a pivot shaft 52 which, in turn, supports spaced-apart latch plates 53. Each latch plate includes an arcuate body section that resembles a segment of a circle and a curved end portion 54 projecting from one side edge of the latch plate. A pocket 55 is formed by the projecting end portion 54 with the arcuate body section. A latch handle 56 is attached to the latch plate for rotation thereof between a locked position, as shown, and an unlatched position shown by phantom lines. In the locked position, the pocket 55 receives a latch bar 57 having a circular cross section. At the other peripheral edge of the latch plate there is a latch bar 58 having a square cross section. Bars 57 and 58 are supported by brackets 59 attached to the top and bottom parts of the door 37. In the locked position, the latch plate 53 projects through an opening 61 in the side wall 22 of the container and extends between latch bar 57 and latch bar 58. The curved projecting end 54 partially wraps around the latch bar 57 where its terminal end extends into an opening 62 formed in the side wall of a tubularly-shaped reinforcement 63 forming part of the door 37. The pivotal latch plate is held captive between the latch bars for load-bearing contact. Such contact occurs when the door may be swung about its hinged connection on partitive wall 34. An outward force on the door 37 moves bar 58 into contact with latch plate 53. However, very little, if any, torque is imposed on shaft 52, whereby the latch handle 56 can be moved by an operator without the need to resist a release force due to the load imposed on the door.

Returning, now, to FIGS. 1 and 2, the compactor apparatus 12 includes a housing frame 65 having a rectangular box-like configuration supported by depending legs 66. The legs are preferably secured by foundation bolts in a manner per se well known in the art. The space enclosed by the housing frame 65 is subdivided by a partitive wall 67 such that the space between partitive wall 67 and one side wall 65A of the housing frame substantially corresponds to the width of compartment 32 and the space between partitive wall 67 and side wall 65B substantially corresponds to the width of compartment 33 of the container. At opposite lateral sides of the partitive wall within the housing frame, there are arranged piston and cylinder assemblies 71 and 72. The cylinder end of each piston and cylinder assembly is supported by a clevis assembly 73; while the rod end is attached by a clevis pin to a bracket formed on the forward wall of a compactor ram. Reference numeral 74 identifies a compactor ram that is operatively coupled to piston and cylinder assembly 71 and reference numeral 75 identifies a compactor ram operatively connected to piston and cylinder assembly 72. The rams 74 and 75 embody the same construction of parts that includes a rectangular weldment having a front material-engaging wall 76 joined with top and bottom walls 77 and 78, respectively, closed at their opposite lateral sides by walls so as to form a hollow structure for receiving the forward portion of the piston and cylinder assembly. Guide bars 79 support the top of the ram during movement toward and away from the container while the ram moves along a floor plate 81.

While not shown in the drawings, the usual fluid supply and delivery ports commonly employed for directing pressurized fluid to opposite sides of the piston in each piston and cylinder assembly are coupled to a source of pressurized fluid including valves for admitting fluid to either side of the piston. Limit switches and other well-known forms of control apparatus may be used for positioning and controlling movement of each ram. Each ram moves within the housing frame from a retracted position as shown in FIGS. 1 and 2 to an extended position wherein it traverses a charging box. Ram 74 cooperates with charging box 82 and ram 75 cooperates with charging box 83. The charging boxes are formed by internal side walls within the housing frame which includes a chute opening in the top wall in the housing frame adjoined with a security chute assembly. The details of the construction of two forms of security chute assemblies will be described in greater detail hereinafter in regard to FIGS. 6–9. Materials fed into the charging boxes 82 and 83 are separated by classification of the material whereby material for recycling, such as paper and paper products, is fed into only one charging box while all other refuse is fed into the other charging box. Since waste materials from shopping centers, food markets, department stores, warehouses, offices, schools and the like have been found to consist of between 70%–75% paper and paper products, this material will be fed by the chute assembly into charging box 82 and thence transferred by operation of the compactor ram 74 into compartment 32 of the container. The remaining amount of waste material is directed by the chute assembly into charging box 83 for movement into compactor compartment 33.

Figure 6:
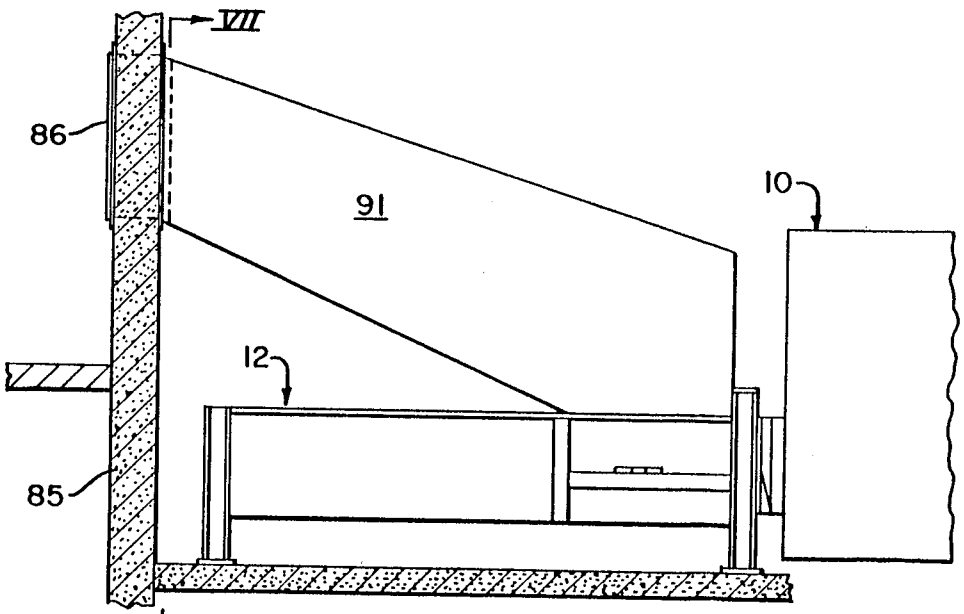
FIG. 6 illustrates one arrangement of the materialsupply chute extending between a building and a compactor device forming part of the present invention.
Figure 7:
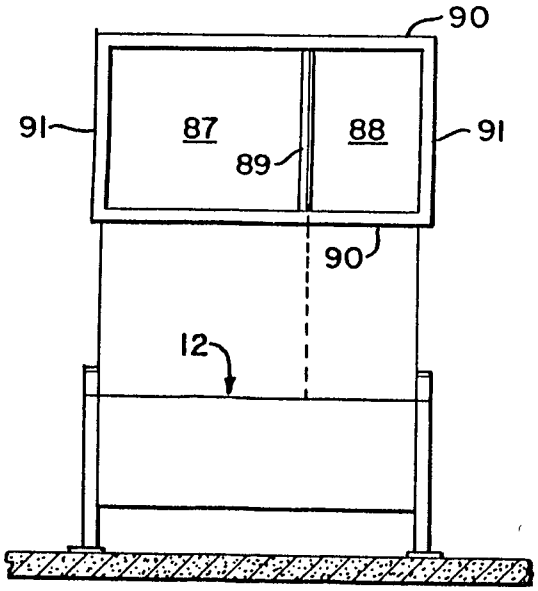
FIG. 7 is a front elevational view taken along line VII—VII of FIG. 6.

FIGS. 6 and 7 illustrate one form of chute apparatus for the delivery of waste materials in separate manner to each of the charging boxes 82 and 83. The use of such delivery chutes is preferred to not only provide an effective means to segregate different types of waste, but also forms an enclosed security chute extending between a building and the compactor to protect against pilferage, entry and inclement weather. Such chutes additionally insure safety for personnel involved in handling of waste material. In FIG. 6, the compactor 12 extends outwardly from a spaced relation with the wall 85 of a building; whereby the side-by-side charging boxes are located at a more distal point from the building than the rear part of the compactor. The wall 85 of the building has on its inside wall surface a security door 86 which is supported by hinges along one side edge so that when it is in its open position, exposes the openings of side-by-side security chutes 87 and 88. The separation between these chutes is effected by means of a partitive wall 89 extending into supporting contact with roof and floor walls 90 and in parallel spaced-apart relation from side walls 91 to insure orderly movement of materials in both of the chutes. The bottom and top walls 90 extend in a downwardly-inclined manner from a point that is spaced at a convenient height above the floor in the building. The discharge end of the chute is attached by a flange to the top wall of the compactor.

Figure 8:
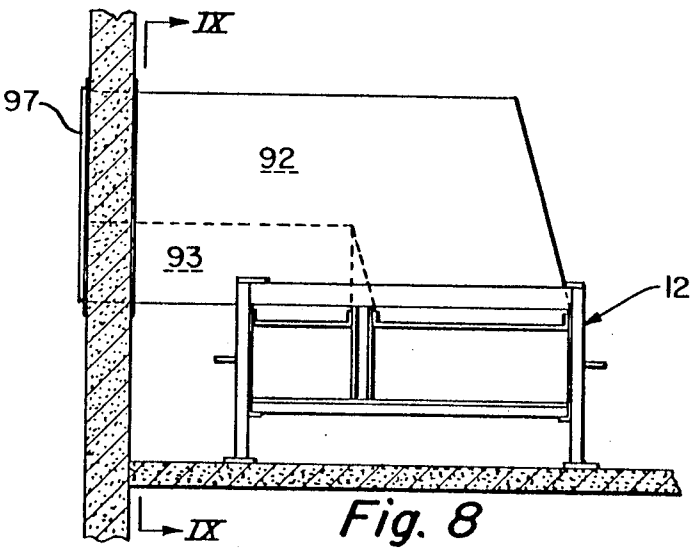
FIG. 8 is a view similar to FIG. 6 but illustrating another form of a chute.
Figure 9:
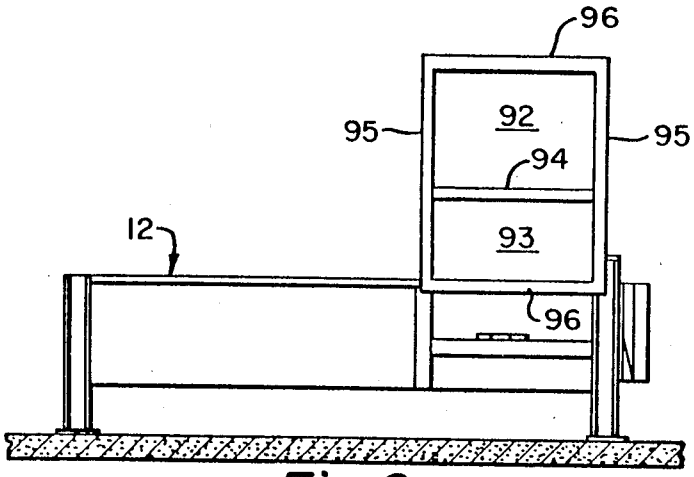
FIG. 9 is a front elevational view taken along line IX—IX of FIG. 8.

As FIGS. 8 and 9 illustrate, another chute assembly arranged to communicate with the compactor 12 is supported to extend along in a generally parallel relation with the wall 85 of the building. When the compactor is arranged in this manner in relation to a building, the security chutes 92 and 93 are arranged one above the other with one chute, preferably the upper and larger chute, extending the greatest lateral distance away from the outside of the building wall. Partitive wall 94 extends in a generally lateral direction between vertical side walls 95 and generally parallel and spaced from top and bottom walls 96. The discharge ends of the chutes are affixed to the top wall of the compactor by a flange through suitable fasteners. A security door 97 is hinged to the inside wall of the building.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A material-handling apparatus including a container having upstanding side walls, a bottom wall and a roof wall adjoined along the side edges thereof, said container further having a front end wall means adjoined with one end of said walls and rear door means at the other ends of said walls, hinge means to support said rear door means on one of said walls, an internal partitive wall supported by said floor wall and roof wall between said side walls for subdividing the space enclosed by said walls into two longitudinal storage compartments, each at an opposite lateral side of the internal partitive wall, latch means to retain said rear door means in closed position against part of some of said walls to define two portal openings each communicating with one of said two storage compartments for separate passage of material into each of the compartments, a compartment door to form an enclosure for one of said two compartments, hinge means for swinging said compartment door between said partitive wall and one of said side walls, a pivot shaft supported by one of said side walls, a pivotal latch plate having an arcuate body section with a curved projecting end portion to move along a radial path about said pivot shaft, spaced-apart latch bars supported by said compartment door to receive the curved projecting end of a latch plate therebetween for preventing swinging of the compartment door about said hinge means, said curved projecting end portion of the pivot latch plate being movable into a locked position by partly wrapping around one of said latch bars to captively engage between said latch bars for load-bearing contact to effectively increase the rigidity of said partitive wall and said side walls, transfer means including two rams each communicating with one portal opening to separately advance material into said compartments under a compacting force, and means to support said transfer means for detachable connection with said container.

2. A material-handling apparatus including a container having upstanding side walls, a bottom wall and a roof wall adjoined together along the side edges thereof, said container further having a front end wall means adjoining with one end of said walls and rear door means supported by hinges at the other ends of said walls to form a partial end closure for the space between said side walls, an internal partitive walls extending between said floor wall and roof wall for subdividing the space enclosed by said walls into two longitudinal storage compartments, each at an opposite lateral side of the internal partitive wall, latch means to retain said rear door means in closed position against part of some of said walls to define two portal openings each communicating with one of said two storage compartments for separate passage of material into each of the compartments, and means for resisting the separating force by compressed material on the vertical sides of one of said compartments, said apparatus further including ground supported transfer means separate from said container, said transfer means including two rams each communicating with one portal opening to separately advance material into said compartments under a compacting force, two charging chambers each having a material-receiving opening traversed by one of said rams for displacing material into a compartment of said container, means to support said transfer means for detachable connection with said container, and means for releasably clamping said transfer means to said container.

* * * * *